United States Patent [19]

DePasquale et al.

[11] Patent Number: 5,033,622

[45] Date of Patent: Jul. 23, 1991

[54] CARTON AND BLANK FOR PACKAGING ICE CREAM AND THE LIKE

[75] Inventors: John P. DePasquale, Penfield, N.Y.; Patricia A. Josephs, Williamsburg, Va.

[73] Assignee: Paperboard Industries, Inc., Newport News, Va.

[21] Appl. No.: 599,885

[22] Filed: Oct. 19, 1990

Related U.S. Application Data

[63] Continuation-in-part of Ser. No. 579,635, Sep. 10, 1990.

[51] Int. Cl.[5] ..... B65D 5/54

[52] U.S. Cl. ..... 206/611; 206/615; 206/624; 229/128; 229/145

[58] Field of Search ..... 229/905, 145, 160, 128; 206/608, 611, 615, 626, 624; 493/136

[56] References Cited

U.S. PATENT DOCUMENTS

| | | | |
|---|---|---|---|
| RE 33,204 | 4/1990 | Froom . | |
| 610,235 | 9/1898 | Bisler . | |
| 635,377 | 10/1899 | Ferrell | 229/160 |
| 1,080,190 | 12/1913 | Bauer . | |
| 1,372,218 | 3/1921 | Davidson . | |
| 2,160,164 | 5/1939 | Palmer . | |
| 2,496,043 | 1/1950 | Farrell . | |
| 2,670,128 | 2/1954 | Stowitts . | |
| 3,000,548 | 9/1961 | Frazier . | |
| 3,015,430 | 1/1962 | Bauer | 229/145 |
| 3,097,783 | 7/1963 | Burt et al. . | |
| 3,854,651 | 12/1974 | Osborne . | |
| 4,084,489 | 4/1978 | Matovich, Jr. . | |
| 4,569,184 | 2/1986 | Strombeck . | |
| 4,712,689 | 12/1987 | Froom . | |
| 4,712,730 | 12/1987 | Froom . | |
| 4,749,086 | 6/1988 | Donohie | 206/611 |
| 4,756,470 | 7/1988 | DePaul . | |
| 4,757,902 | 7/1988 | Hutchinson et al. . | |
| 4,819,864 | 4/1989 | Capuano . | |
| 4,826,074 | 5/1989 | DePaul | 229/905 |
| 4,838,432 | 6/1989 | DePaul | 229/905 |
| 4,872,609 | 10/1989 | DePaul | 229/905 |

FOREIGN PATENT DOCUMENTS

| | | | |
|---|---|---|---|
| 1096828 | 3/1981 | Canada | 229/905 |
| 651573 | 1/1963 | Italy . | |
| 1018426 | 1/1966 | United Kingdom . | |

*Primary Examiner*—Stephen Marcus
*Assistant Examiner*—Christopher McDonald
*Attorney, Agent, or Firm*—Shlesinger, Arkwright and Garvey

[57] ABSTRACT

A carton for packaging ice cream or the like, one embodiment of which includes front, rear and bottom panels. A lid is operably associated with the front, rear and bottom panels for forming a hollow tube having first and second open ends. The lid includes a cover panel and means for securing the cover panel to one of the front, rear and bottom panels. A first set of end flaps are operably associated with the first open end of the hollow tube for sealing the first open end. A second set of end flaps are operably associated with the second open end of the hollow tube for sealing the second open end. The first set of end flaps include at least first and second end flaps, the first end flap is offset inwardly of the second end flap. A first membrane flap extends from the second end flap of the first set of end flaps and inwardly toward the second set of end flaps. First spacing means is provided for forming an opening between the first end flap of the first set of end flaps and the cover panel for receiving the first membrane flap. The first spacing means is formed on a portion of the carton removed from an upper edge of the first end flap of the first set of end flaps.

74 Claims, 6 Drawing Sheets

FIG. 2
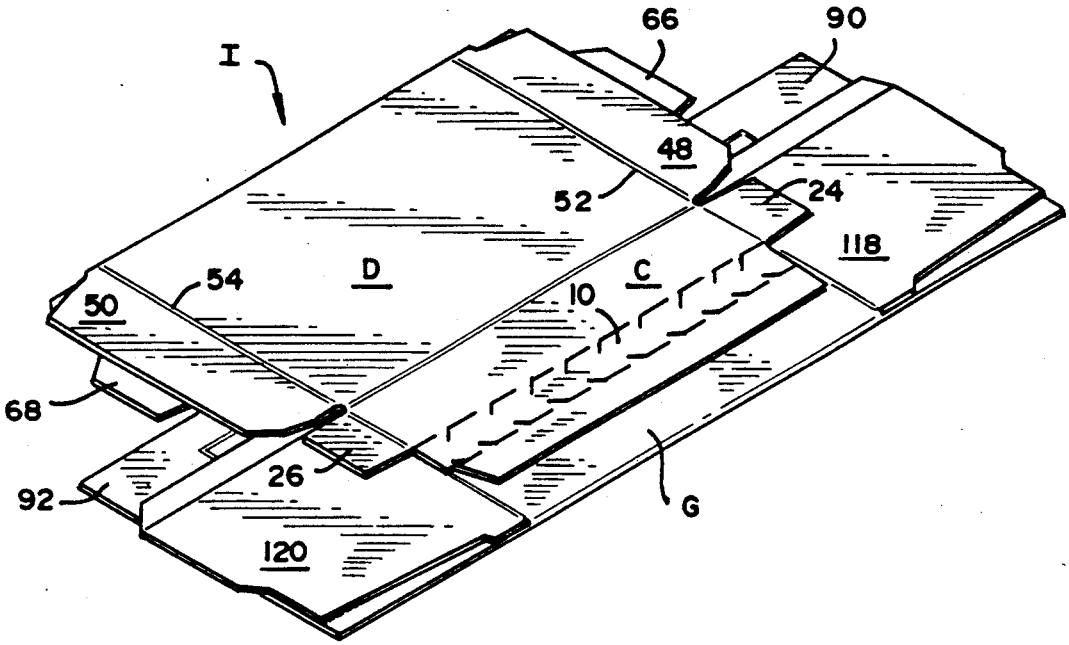
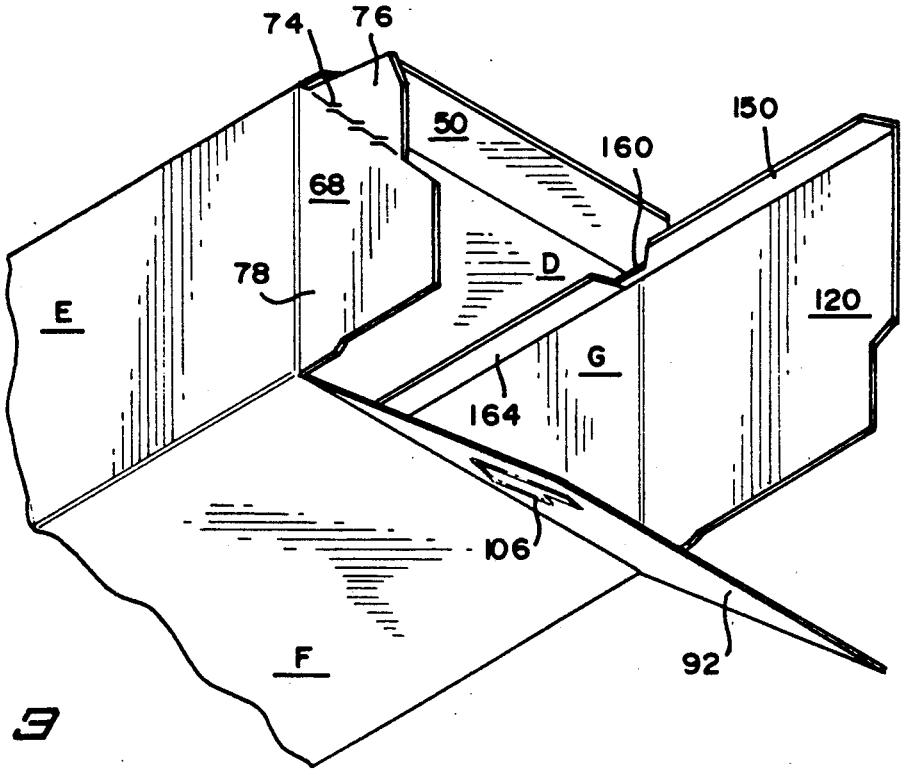
FIG. 3

FIG. 4
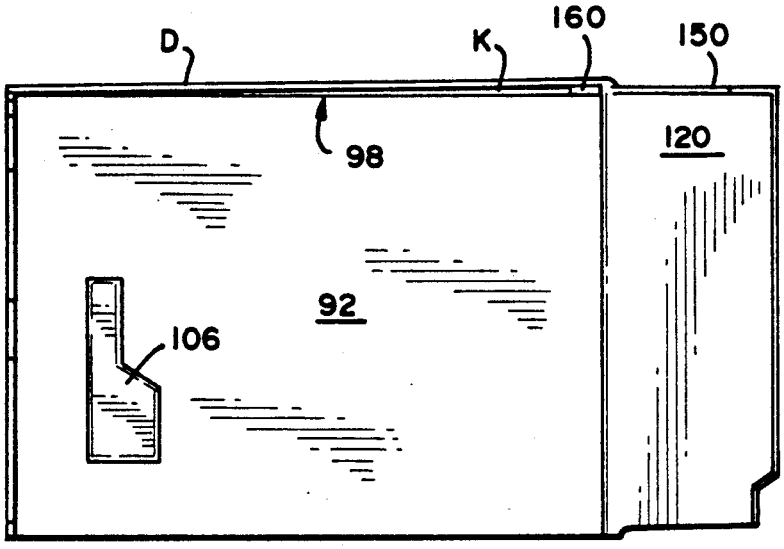
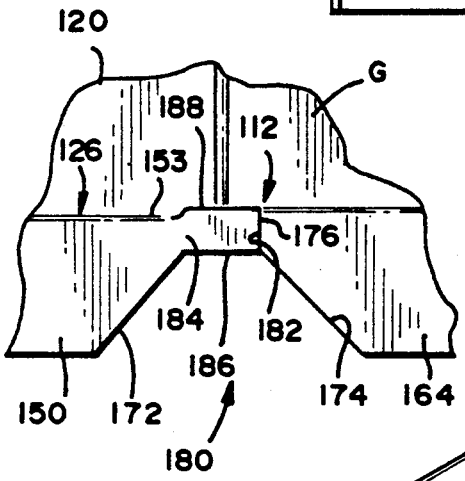
FIG. 5
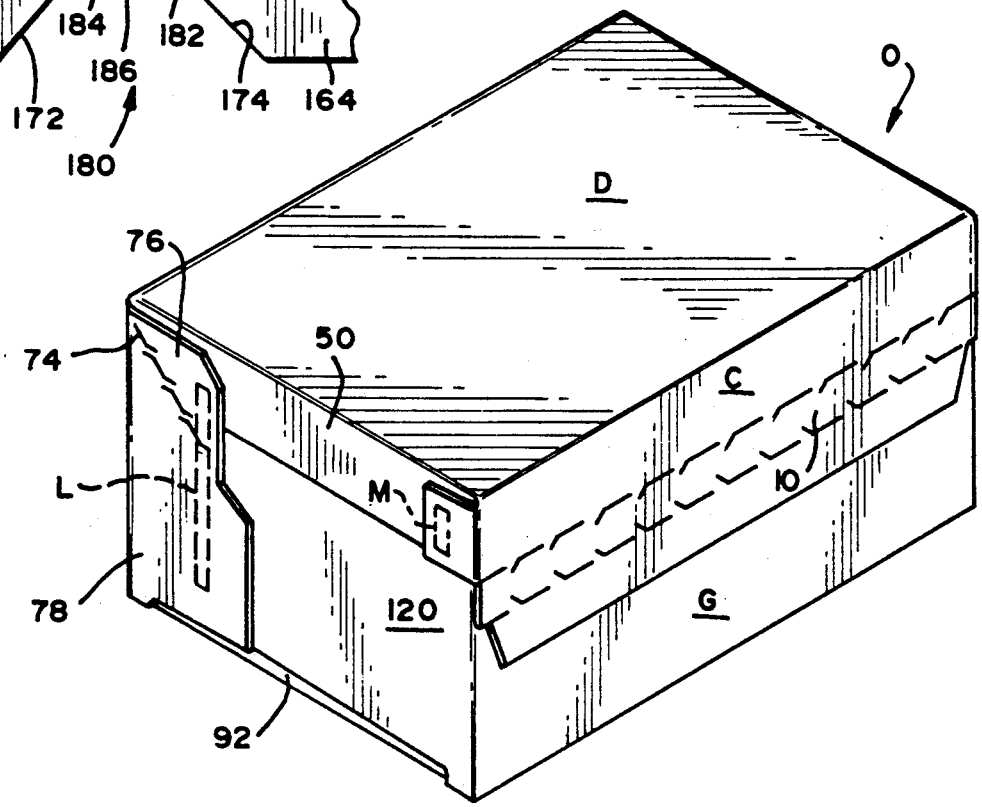
FIG. 6

CARTON AND BLANK FOR PACKAGING ICE CREAM AND THE LIKE

CONTINUATION DATA

This application is a continuation-in-part of U.S. patent application Ser. No. 07/579,635 filed on Sept. 10, 1990.

FIELD OF THE INVENTION

The present invention pertains to blanks, cartons and methods for packaging such commodities as ice cream and the like.

BACKGROUND OF THE INVENTION

Numerous designs for containers for packaging ice cream and like commodities have been proposed. The assignee of the subject application is the owner of the following U.S. patents and patent applications: U.S. Pat. Nos. 4,239,115; 4,328,656; 4,431,129; 4,526,563; 4,555,027; 4,679,694; D 293,211; 4,669,614; 4,749,086; 4,756,470; 4,757,902; 4,838,432; 4,819,864; 4,826,074; 4,872,609; RE 33,010; RE 33,204; U.S. patent applications Ser. No. 023,845; Ser. No. 132,856; and Ser. No. 138,026 which are incorporated herein by reference.

The aforementioned U.S. patents and applications relate to the design, manufacture, filling and assembly of carton blanks for packaging such commodities as ice cream and the like. At the outset, as is readily evident from the above documents, a carton blank is mass produced from web or sheet stock. Carton blanks, so produced, are subsequently erected, filled, and sealed by a high speed cartoner. More specifically, the cartoner erects the carton blank from a collapsed carton tube forming a hollow tube with first and second open ends. The end flaps disposed adjacent one end of the tube are folded in and adhesively secured to form a sealed carton end. A filler head is aligned with the remaining open end to dispense ice cream in a semi-liquid or liquid state into the partially erected carton blank. Once filled, the end flaps of the remaining open end are folded in and adhesively secured thereby forming a sealed carton.

The above manufacturing, filling and assembly processes dictate several desirable characteristics for a blank and carton. In this regard, it is advantageous for a blank to be designed such that a minimal amount of scrap or waste material is produced during the blanking process. Additionally, the end flaps necessarily must be adapted to be sequentially folded without hinderance. Moreover, it is imperative that the erected carton have an adequate seal to prevent leakage of the contents therefrom.

The present invention is directed to a novel and unobvious blank, carton and method for forming the same embodying the aforementioned desirable attributes.

OBJECTS AND SUMMARY OF THE INVENTION

It is an object of the present invention to provide an improved blank and carton for packaging semi-liquids or liquids such as ice cream and the like.

Another object of the present invention is to provide a carton blank that can be readily erected by mechanical means.

A further object of the present invention is to provide a carton that can be manufactured in multiples, from web or sheet stock, with minimum waste or scrap produced during the blanking operation and the efficient nesting of one blank against another.

Yet another object of the present invention is to provide a carton for packaging semi-liquids or liquids such as ice cream or the like with a superior seal.

Still a further object of the present invention is to provide a carton that can be readily resealed after initial opening of the same.

Still yet a further object of the present invention is to provide a carton with a lip seal extending along at least a portion of an outer periphery thereof which can be readily erected by mechanical means.

Another object of the present invention is to provide a carton with a lip seal having first, second, and third membrane flaps and at least one of which extends along an upper edge of a panel and an upper edge of an associated end flap so that a blank can be readily erected by mechanical means without hinderance.

A further object of the present invention is to provide a carton blank which obviates the need for precisely forming cutouts in the first end flap which receives the first membrane flap thereby significantly expediting the blanking and assembly processes.

Still another object of the present invention is to provide a carton blank the thickness of which can be readily varied.

Yet another object of the present invention is to provide a carton blank with a lip seal having first, second and third sections and a tab extending between at least one of the first and second sections and the first and third sections to enhance the sealing and folding characteristics of the lip seal especially at the adjoining areas of the first, second and third sections.

Still yet another object of the present invention is to provide a carton blank the first-in end flaps of which are free from abrupt cut-outs formed in the edges thereof eliminating the assembly and leakage problems associated therewith.

In summary, the present invention is directed to a blank, a carton and a method for forming the same. More specifically, the present invention relates to a blank and a carton including a lip seal extending along at least a portion of an outer periphery thereof for enhancing the overall seal of the carton and for facilitating the assembly thereof by a high speed cartoner.

These objects and advantages of the present invention as well as others will be readily apparent from the following detailed description of the preferred embodiments.

DETAILED DESCRIPTION OF THE DRAWINGS

FIG. 2 is a plan view of a carton blank partially folded.

FIG. 3 is a fragmentary perspective view of a carton blank erected to form a hollow tube and illustrating one end thereof.

FIG. 4 is a side elevational view of the left end of the carton with only the bottom panel end flap folded inwardly.

FIG. 5 is an enlarged fragmentary view of a portion of the carton blank illustrated in FIG. 1.

FIG. 6 is a perspective view of the carton blank of FIG. 1 fully erected and sealed.

DETAILED DESCRIPTION OF THE INVENTION

FIG. 1

The specific nomenclature assigned to each component and subcomponent comprising carton blank A and the alternative embodiments thereof, unless stated to the contrary, refers to its orientation when the carton blank is fully erected and as viewed in the direction of arrow B in FIG. 6.

Figure 1:
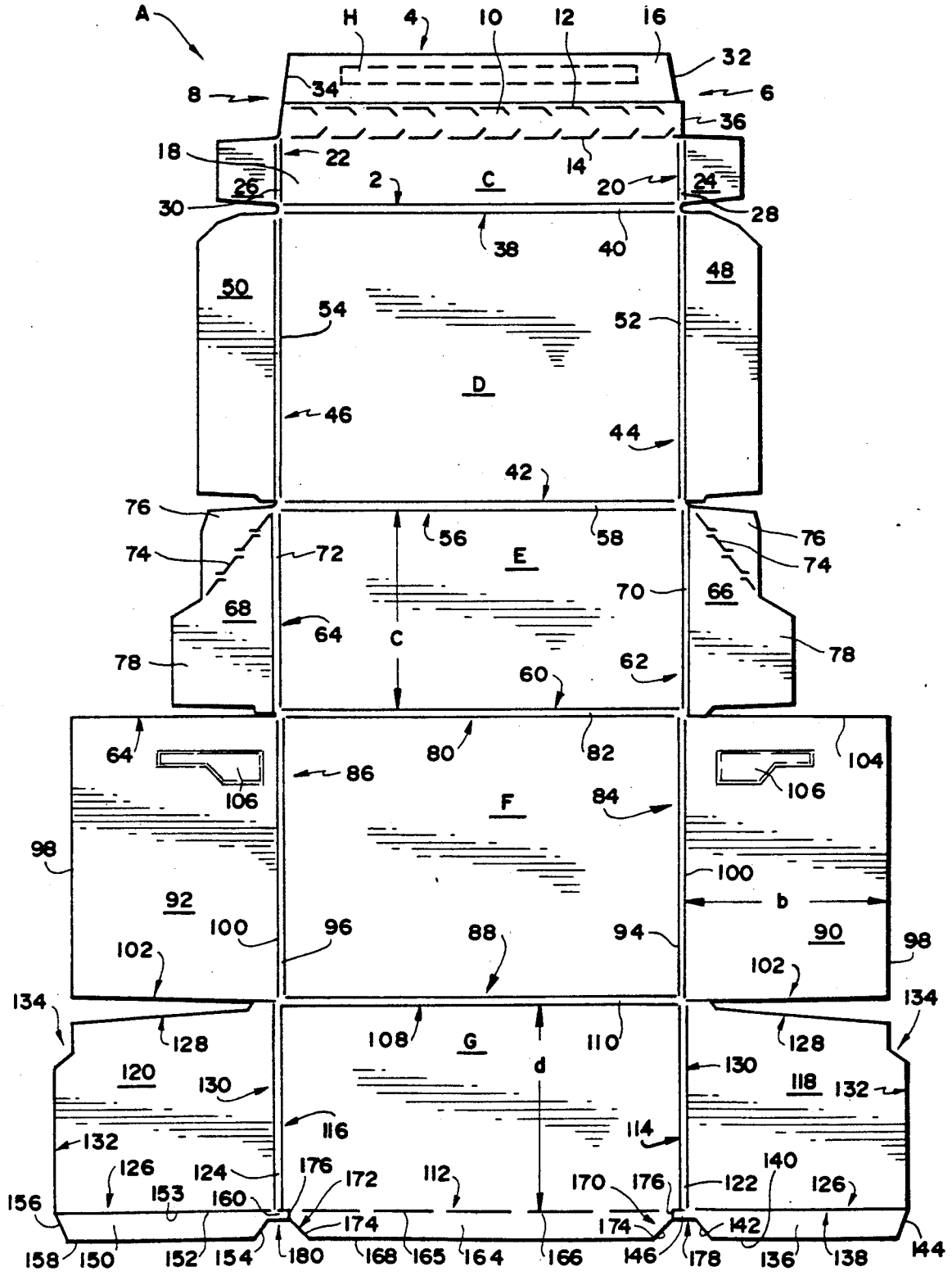
FIG. 1 is a plan view of the inner surface of a flat carton blank formed in accordance with the present invention.

Referring to FIG. 1, carton blank A includes a closure flap C, a cover panel D, a rear panel E, a bottom panel F, and a front panel G. The carton blank A has a substantially uniform thickness and is oriented to illustrate the inner surface thereof. Closure flap C includes a top edge 2, a bottom edge 4, a right edge 6, and a left edge 8. Closure flap C further includes a tear strip 10. Tear strip 10 includes weakness lines 12 and 14 which subdivide closure flap C into glue panel or segment 16 and skirt or resealable flap 18. Skirt 18 includes right and left edges 20 and 22. Cover tabs 24 and 26 are hingedly connected to right and left edges 20 and 22, respectively, forming hinge lines 28 and 30 therebetween. Glue segment 16 includes right and left edges 32 and 34 which form an angle of less than 180° with corresponding right and left edges 20 and 22 of skirt 18.

Right end 32 is inwardly offset from end tab 36 of tear strip 10. This arrangement enables the consumer to readily remove the tear strip 18 and detach the cover panel D from the front panel G to gain access to the contents of the carton. It will be readily appreciated that various other types of tear tabs and tear strips may be used.

Cover panel D is hingedly connected at its front edge 38 to top edge 2 of closure flap C forming horizontally extending hinge line 40 therebetween. Cover panel D further includes rear edge 42, right edge 44, and left edge 46. Cover panel end flaps 48 and 50 are hingedly connected to right and left edges 44 and 46, respectively, forming vertically extending hinge lines 52 and 54 therebetween.

Rear panel E is hingedly connected at its top edge 56 to rear edge 42 of cover panel D forming horizontally extending hinge line 58 therebetween. Rear panel E further includes bottom edge 60, right edge 62, and left edge 64. Rear panel end flaps 66 and 68 are hingedly connected to right and left edges 62 and 64, respectively, forming therebetween vertically extending hinge lines 70 and 72. Vertically extending hinge lines 70 and 72 are offset outwardly from corresponding hinge lines 52 and 54 of cover panel D. Rear panel end flaps 66 and 68 each include weakness lines 74 formed therein. Weakness lines 74 subdivide each of the rear panel end flaps 66 and 68 into a breakaway portion 76 and body portion 78.

The rear edge 80 of bottom panel F is hingedly connected to the bottom edge 60 of rear panel E forming horizontally extending hinge line 82 therebetween. The bottom panel F further includes right edge 84, left edge 86 and front edge 88. Right and left end flaps 90 and 92 are hingedly connected to right and left edges 84 and 86, respectively, forming hinge lines 94 and 96 therebetween. Bottom panel end flaps 90 and 92 each include upper, lower, front and rear edges 98, 100, 102, and 104, respectively. Upper edge 98 extends parallel to lower edge 100 In the preferred embodiment, the upper edge 98 is spaced from lower edge 100 a distance b which is equal to the distance c between upper edge 56 and lower edge 60 of rear panel E. Bottom panel end flaps 90 and 92 each include an embossed or raised portion 106.

Front panel G includes bottom edge 108 hingedly connected to front edge 88 of bottom panel F forming therebetween horizontally extending hinge line 110. The front panel G also includes upper edge 112, right edge 114, and left edge 116. In the preferred embodiment, the distance d between upper edge 112 and bottom edge 108 is equal to the distance b. However, the distance b may be varied. Right and left cover panel end flaps 118 and 120 are hingedly connected to right and left edges 114 and 116, respectively, forming hinge lines 122 and 124 therebetween. Right and left cover panel end flaps 118 and 120 each include an upper edge 126, a lower edge 128, a front edge 130 and a rear edge 132. The rear edge 132 includes a cut-out portion 134 which conforms to the configuration of corresponding embossed portions 106. The function and purpose of embossed portions 106 and the corresponding cut-outs 134 are fully explained in U.S. Pat. No. 4,756,470.

Right membrane flap 136 is foldably connected at its outer edge 138 to upper edge 126 of right front panel end flap 118. The right membrane flap further includes an inner edge 140, a front edge 142 and a rear edge 144. The front edge 142 is cut on an angle of approximately 45°. The front edge 142 may be cut on an angle slightly less than 45° to facilitate assembly of the blank A. As best seen in FIG. 5, a J-tab 146 is integral with and extends from the front edge 142 of right membrane flap 136.

A left membrane flap 150 is foldably connected at its outer edge 152 to the upper edge 126 of left front panel end flap 120 forming fold line 153. Left membrane flap 150 further includes front edge 154, rear edge 156 and inner edge 158. Front edge 154 is cut at an angle of approximately 45°. The front edge 154 may be cut on an angle slightly less than 45° to facilitate assembly of blank A. A J-tab 160 is integral with and extends from the front edge 154 of left membrane flap 150.

A center membrane flap 164 at its front edge 166 is foldably connected to top edge 112 of front panel G. A plurality of slits 165 are formed intermediate center membrane flap 164 and front panel G. Furthermore, the slits 165 are offset inwardly of the fold lines formed between membrane flaps 136 and 150 and the corresponding right and left front panel end flaps 118 and 120. The center membrane flap 164 also includes rear edge 168, right edge 170 and left edge 172. Right and left edges each include first portion 174 cut on an angle of approximately 45° and second portion 176 extending substantially parallel to corresponding hinge lines 122 and 124. First portions 174 may be cut on an angle less than 45° to facilitate folding of the carton blank A. The first portions 174 and the corresponding front edges 142 and 154 form substantially v-shaped notches 178 and 180. J-tabs 146 and 160 are positioned adjacent the outer portions of corresponding substantially v-shaped notches 178 and 180.

Referring to FIG. 5, the details of J-tabs 146 and 160 will now be described. Although FIG. 5 illustrates J-tab 160, J-tab 146 is constructed in a reverse manner. J-tab 160 includes a front edge 182, a rear edge 184, an inner edge 186 and an outer edge 188. Outer edge 188 extends along and is detached from upper edge 126 of left front panel end flap 120 and upper edge 112 of front panel G. Outer edge 188 is offset from the fold line 153 formed between left membrane flap 150 and left front panel end flap 120 and is aligned with the fold line formed between center membrane flap 164 and front panel G. Front edge 182 of J-tab 160 extends substantially perpendicular to outer edge 188 and is detached from left edge 174 of center membrane flap 164. J-tabs 146 and 160 and the corresponding membrane flaps 136 and 150 are formed from one piece.

CARTON ASSEMBLY FIGS. 1, 2, 3, AND 6

The preferred method for assembling carton blank A will now be described. An adhesive strip H is applied to the glue segment 16 of closure flap C. Subsequently, the front panel G and the end flaps associated therewith are folded about hinge line 110 to lie flat on bottom panel F and the associated end flaps 90 and 92. The cover panel D and closure flap C are folded about hinge line 58 such that the cover panel D overlies the rear panel E, the bottom panel F and a portion of the center membrane flap 164. The closure flap C lies on the outer surface of front panel G. Pressure is applied to the glue panel 16 to secure the closure flap C to the front panel thereby forming a collapsed carton tube I, as best seen in FIG. 2. A plurality of carton tubes I (approximately 250) are positioned in a hopper of a high speed cartoner, i.e. a mechanical device for erecting, filling and sealing a carton. The cartoner first erects the collapsed carton tube to form a hollow rectangularly shaped tube with first and second open ends. In this step, the J-tabs 146 and 160 are folded such that they extend perpendicular to the corresponding front panel end flaps 118 and 120 and the front panel G. Since the outer edge 188 of J-tabs 146 and 160 is detached, they can be readily oriented in this manner. By forming slits 165 in the blank A and offsetting them from hinge lines 138 and 152, the center membrane flap 164 is disposed below the left and right membrane flaps 136 and 150.

The tube I, with the body panels erected and end flaps extending substantially planar to the corresponding body panels, is positioned to move through the cartoner with the cover panel D leading. The cartoner performs all folding steps to the lower or left end flaps, including the application of adhesive prior to filling. Specifically, bottom panel end flap 92 is folded inwardly so that it is substantially perpendicular to bottom panel F. As seen in FIGS. 3 and 4, when the bottom panel end flap 92 is folded inwardly it engages the J-tab 160 at its upper edge 98. The J-tab 160 acts to space the upper edge 98 of the bottom panel end flap 92 from the cover panel D thereby forming an opening K best seen in FIG. 4. The right end 170 of membrane flap 164, which is disposed below the J-Tab 160, acts as a stop to prevent the bottom panel from being folded inwardly past the vertical. The front panel end flap 120 is folded in to overlie the bottom panel end flap 92 such that left membrane flap 160 is inserted into opening K and cutout portion 134 cooperates with embossed portion 106. The J-tab 160 has a thickness equal to that of left membrane flap 150 and thereby forms a sufficient space between the upper edge 98 of the bottom panel 92 and the cover panel D to receive that portion of the left membrane flap adjacent its front edge 154. As is readily evident from FIG. 4, the opening K diminishes in width along the upper edge 98 of bottom panel end flap 92. This feature acts to bias or wedge the left membrane flap 150 along the entire length thereof upwardly into engagement with the cover panel D thereby forming a tighter seal. The integral relationship between the J-tab 160 and the left membrane flap 150 prevents any misalignment between opening K and left membrane flap 150 during the folding steps. The cover panel end flap 50 is subsequently folded about hinge line 54 to overlie front panel end flap 120 and bottom panel end flap 92. Adhesive strips are applied to the carton end. Specifically, a single adhesive strip L is applied such that it extends vertically over the embossed portion 106 of the bottom panel end flap 92 and a portion of the cover panel end flap 50 disposed adjacent breakaway tab 76. Glue strip I is applied to a portion of front panel end flap corresponding to embossed portion 106. Glue strip M is applied to the cover panel end flap 50 adjacent the front panel G. Once the glue strips have been applied, the rear panel end flap 68 and cover tab 26 are folded inwardly and pressure is applied thereto to form a sealed carton end.

A filler head of the cartoner is aligned with the open right end to dispense ice cream in a semi-liquid or liquid state. The end flaps 48, 66, 90 and 118 are folded back about their respective hinge lines to form a throat for receiving the filler head. Since the J-tab 146 is detached from the center membrane flap 164, tearing is avoided when the front panel end flap 118 is bent back to form the throat for receiving the filler head. Once the contents have been dispensed into the container, the glue tab 24 and end flaps 48, 66, 90 and 118 are folded and secured in the manner described above for the left end of the carton. During assembly, the J-tabs 146 and 160 are deformed or crimped and positioned to lie on center membrane flap 164, see FIG. 7. This aspect of the invention helps to improve the overall seal of the carton. As seen in FIG. 6, the aforementioned assembly process produces a sealed ice cream carton 0.

CARTON OPENING AND RESEALING

Figure 7:
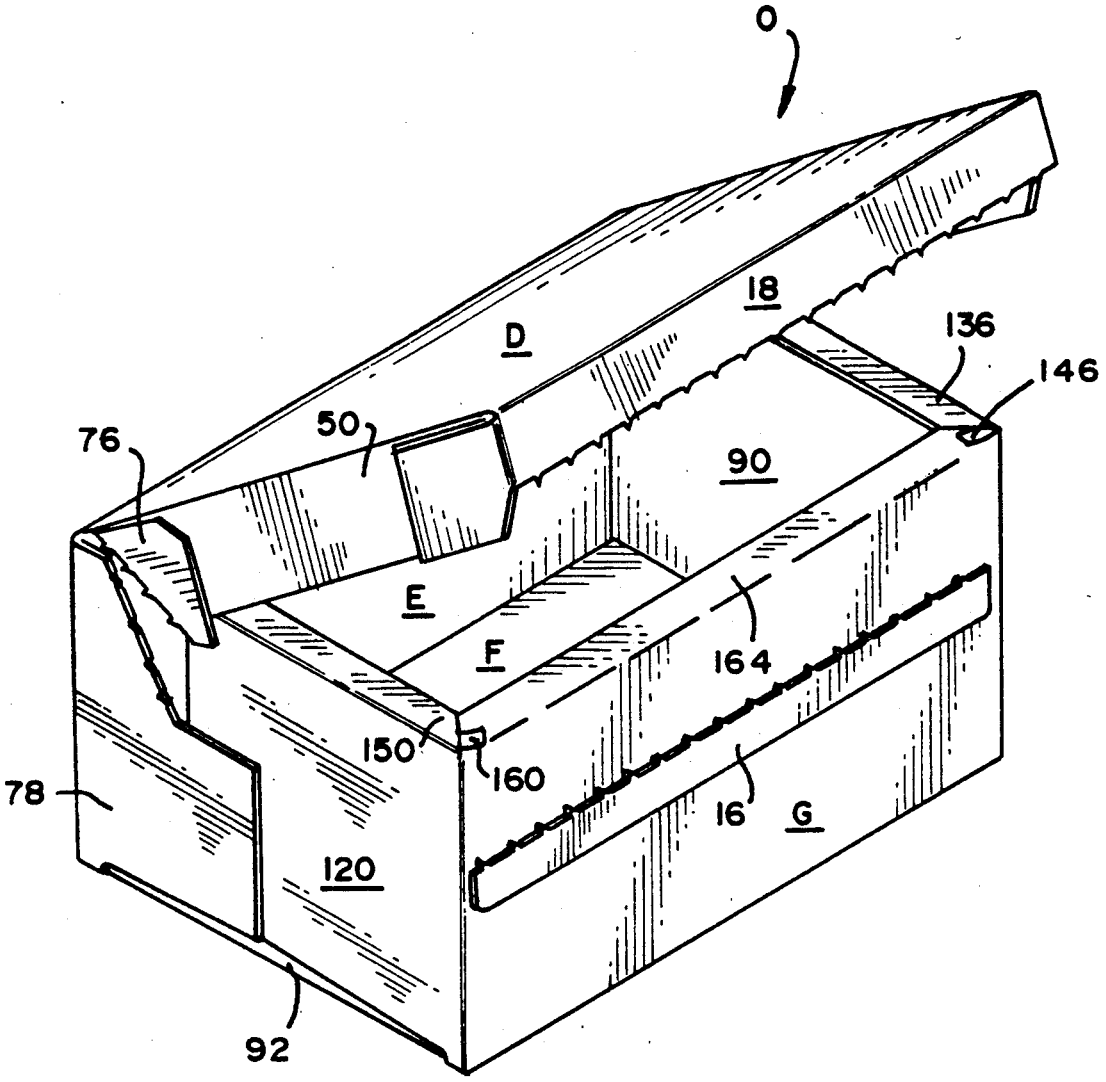
FIG. 7 is a perspective view of the carton in FIG. 6 with the tear strip removed and the lid raised.

Referring to FIGS. 6 and 7, a consumer must remove tear strip 10 from closure flap C to gain access to the contents of carton O. Subsequently, the consumer will lift cover D in an upward direction from front panel G. As the cover D is lifted away from the front panel G, breakaway tabs 76 sever from body portions 78 of corresponding rear panel end flaps 66 and 68. The bottom panel end flaps 90 and 92 and the corresponding rear panel end flaps 66 and 68 form a pocket for receiving the corresponding cover panel end flaps 48 and 50 in order to reseal the carton O.

ALTERNATIVE EMBODIMENTS

Several alternative embodiments of the present invention will now be described. Only those features which differ from the previously described embodiment will be discussed.

Figure 8:
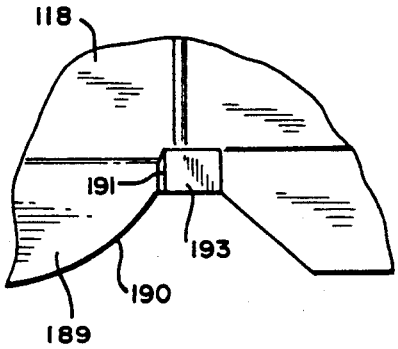
FIG. 8 is a fragmentary plan view of a portion of a flat carton blank formed in accordance with an alternative embodiment of the present invention.

Referring to FIG. 8, an alternative embodiment of the present invention will now be described. Membrane flaps 189 extending from corresponding front panel end flaps 118 and 120 (only one of which is shown) are formed with an arcuate front surface 190. The arcuate configuration of front surface 190 facilitates folding of the front panel end flaps 118 and 120. A hinge line 191 is formed intermediate J-Tab 193 and membrane flap 189.

Figure 9:
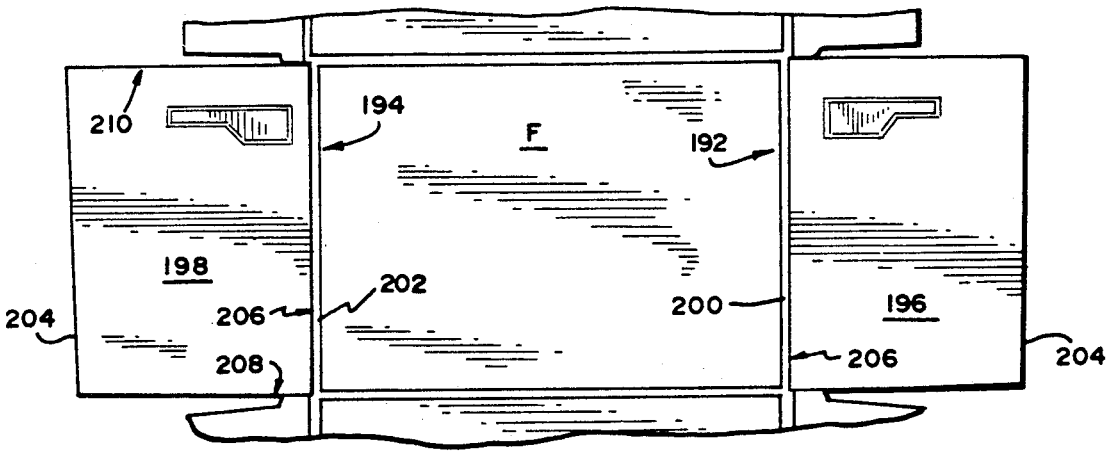
FIG. 9 is a fragmentary plan view of a portion of a flat carton blank formed in accordance with another alternative embodiment of the present invention.

Referring to FIG. 9, another alternative embodiment of the present invention will now be described. Bottom panel F includes right and left edges 192 and 194 Right and left bottom panel end flaps 196 and 198 are hingedly connected to corresponding edges 192 and 194 thereby forming hinge lines 200 and 202 therebetween. The bottom panel end flaps 196 and 198 each include upper edge 204, bottom edge 206, front edge 208 and rear edge 210. Upper edge 204 is tapered from the front edge 208 to the rear edge 210. The rear edge 210 has a length equal to length b of bottom panel end flaps 90 and 92 of carton blank A illustrated in FIG. 1. Front edge 208 has a length which is less than rear edge 210 by an amount equal to the thickness of the board of the carton blank. In the preferred embodiment, the thickness of the carton blank is about 23/1000 of an inch. Once the bottom panel end flaps 196 and 198 are folded inward to form the ends of the carton a tapered space conforming to the tapered upper edge 204 is formed between the bottom panel end flaps 196 and 198 and the cover panel D for receiving the membrane flaps extending from the front panel end flaps. In this embodiment, the J-tabs may or may not be used.

Figure 10:
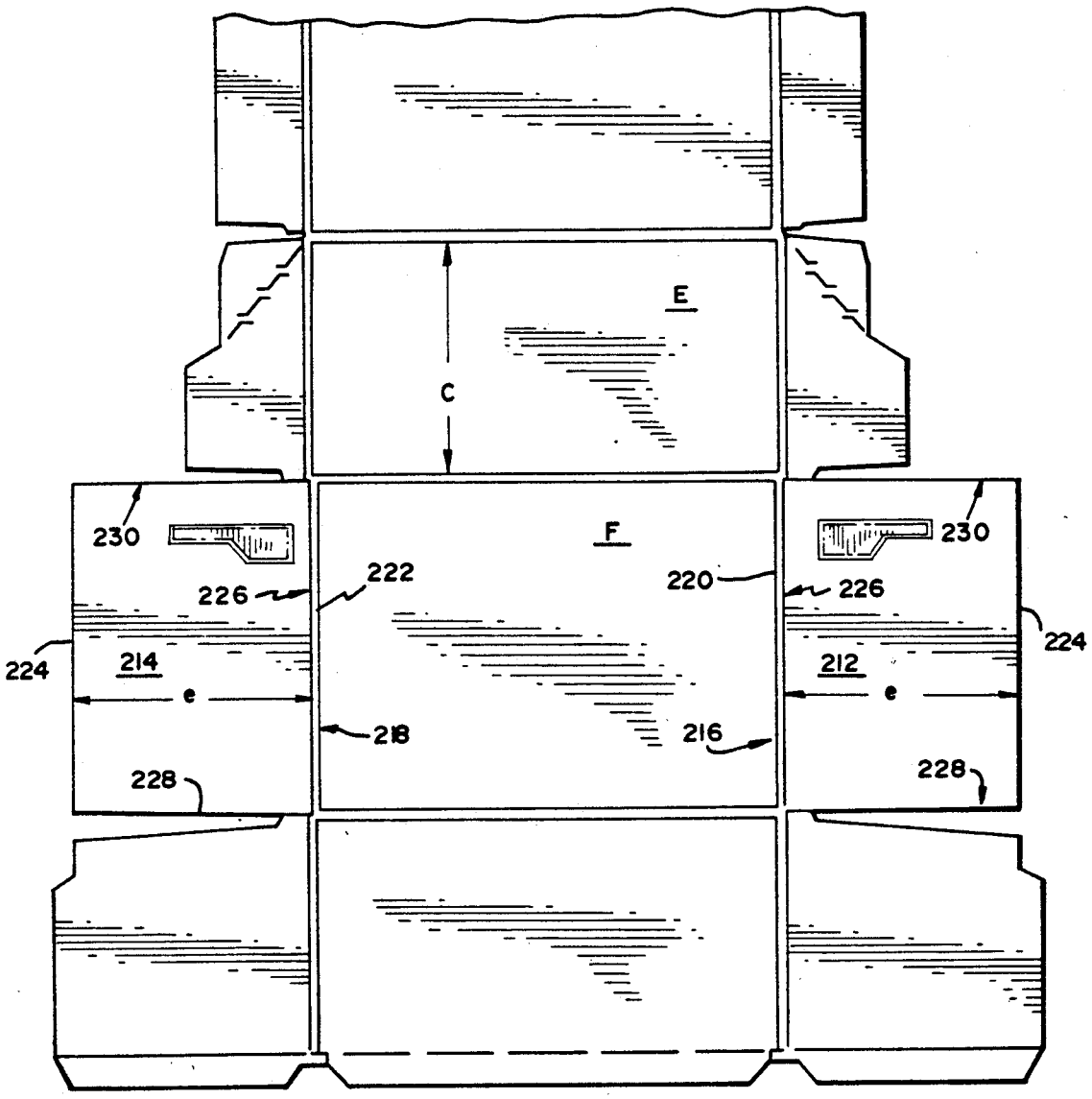
FIG. 10 is a fragmentary plan view of a portion of a flat carton blank formed in accordance with a further alternative embodiment of the present invention.

Referring to FIG. 10, a further alternative embodiment of the present invention will now be described. Bottom panel end flaps 212 and 214 are hingedly connected to right and left edges 216 and 218 of bottom panel F forming hinge lines 220 and 222 therebetween. Bottom panel end flaps 212 and 214 include upper edge 224, bottom edge 226, front edge 228 and rear edge 230. Upper edge 224 extends substantially parallel to bottom edge 226 and is spaced a distance e therefrom. The distance e is slightly less than the distance c, which represents the height of rear panel E, by an amount approximately equal to ½ the carton blank board thickness. The clearance between the bottom panel end flaps 90 and 92 and the cover panel D assists in the insertion of the membrane flaps 136 and 150 of the front panel end flaps 118 and 120.

While this invention has been described as having a preferred design, it is understood that it is capable of further modifications, uses and/or adaptions of the invention following in general the principle of the invention including such departures from the present disclosure as comes within the known or customary practice in the art to which the invention pertains, and as may be applied to the central features set forth and fall within the scope of the invention and the limits of the appended claims.

We claim:

1. A carton for packaging ice cream or the like, comprising:

a) front, rear, and bottom panels;

b) a lid operably associated with said front, rear and bottom panels for forming a hollow tube having first and second open ends, said lid including a cover panel and means for securing said cover panel to one of said front, rear and bottom panels;

c) a first set of end flaps operably associated with said first open end of said hollow tube for sealing said first open end;

d) a second set of end flaps operably associated with said second open end of said hollow tube for sealing said second open end;

e) said first set of end flaps including at least first and second end flaps, said first end flap being offset inwardly of said second end flap;

f) a first membrane flap extending from said second end flap of said first set of end flaps, said first membrane flap extending inwardly toward said second set of end flaps; and g) first spacing means for providing an opening between said first end flap of said first set of end flaps and said cover panel for receiving said first membrane flap, said first spacing means being formed on a portion of said carton removed from an upper edge of said first end flap of said first set of end flaps.

2. A carton as in claim 1, wherein:

a) said second set of end flaps include at least first and second end flaps, said first end flap is offset inwardly of said second end flap;

b) a second membrane flap extending from an upper surface of said second end flap of said second set of end flaps, said second membrane flap extending inwardly towards said first set of end flaps; and c) second spacing means for providing an opening between said first end flap of said second set of end flaps and said cover panel for receiving said second membrane flap, said second spacing means is formed on a portion of said carton removed form an upper edge of said first end flap of said second set of end flaps.

3. A carton as in claim 2, wherein:

a) said front and rear panels each include upper, lower, left and right edges;

b) said cover and bottom panels each include front, rear, left and right edges;

c) said first end flap of said first set of end flaps is hingedly connected to said right edge of said bottom panel forming a hinge line therebetween; and d) said first end flap of said second set of end flaps is hingedly connected to said left edge of said bottom panel forming hinge line therebetween.

4. A carton as in claim 1, wherein:

a) said first end flaps of said first and second sets of end flaps are the innermost end flaps.

5. A carton as in claim 3, wherein:

a) said second end flap of said first set of end flaps is hingedly connected to said right edge of said front panel forming a hinge line therebetween; and b) said second end flap of said second set of end flaps is hingedly connected to said left edge of said front panel forming a hinge line therebetween.

6. A carton as in claim 5, wherein:

a) said first set of end flaps include cover panel and rear panel end flaps hingedly connected to corresponding right edges of said cover and rear panels;

b) said second set of end flaps include cover panel and rear panel end flaps hingedly connected to corresponding left edges of said cover and rear panels;

c) said rear panel end flaps of said first and second sets of end flaps are the outermost end flaps; and d) said first and second sets of end flaps each form pocket means for receiving a portion of corresponding cover panel end flaps for reforming said carton subsequent to initial opening thereof.

7. A carton as in claim 1, wherein:

a) said first end flap of said first set of end flaps includes upper, lower, front and rear edges, said upper edge of said first end flap of said first set of end flaps is tapered from said front edge to said rear edge.

8. A carton as in claim 2, wherein:

a) said first and second membrane flaps include front, rear, inner, and outer edges, said inner edges of said first and second membrane flaps include an arcuate portion; and b) said first and second spacing means each include a tab projecting from a corresponding front edge of said first and second membrane flaps.

9. A carton as in claim 5, wherein:

a) said first and second spacing means each include a tab hingedly connected to corresponding front edges of said first and second membrane flaps forming hinge lines therebetween; and b) said hinge lines between said tabs and said first and second membrane flaps extend substantially perpendicular to and are offset from corresponding hinge lines formed between said second end flaps of said first and second sets of end flaps and said front panel.

10. A carton as in claim 8, wherein:

a) said tabs have a thickness substantially equal to a thickness of a corresponding membrane flap.

11. A carton as in claim 8, wherein:

a) said second end flap of said first set of end flaps extends from said right edge of said front panel, said second end flap of said second set of end flaps extends from said left edge of said front panel;

b) a third membrane flap extends from an upper edge of said front panel; and c) said tabs each include a first edge disposed to extend along at least a portion of said upper edge of said front panel, said first edges of said tabs are detached from corresponding portions of said front panel.

12. A carton as in claim 11, wherein:

a) said tabs each include a second edge disposed to extend substantially perpendicular to corresponding first edges, said second edges are detached from corresponding adjacent ends of said third membrane flap.

13. A carton as in claim 12, wherein:

a) a substantially V-shaped notch is formed intermediate said first and third membrane flaps and said second and third membrane flaps when said carton is in blank form; and b) said tabs are disposed adjacent a bottom portion of a corresponding substantially V-shaped notch.

14. A blank for forming a carton for packaging ice cream or the like, comprising:

a) connected front, rear, bottom and cover panels, said front and rear panels each having upper, lower, left and right edges, said bottom and cover panels each having front, rear, left and right edges;

b) left and right end flaps operably associated with corresponding left and right edges of at least one of said front, rear, bottom and cover panels, said left and right end flaps each having upper and lower edges;

c) first, second and third membrane flaps, said first membrane flap being operably connected to said upper edge of said left end flap, said second membrane flap being operably connected to said upper edge of said right end flap, said third membrane flap being operably connected to a predetermined edge of one of said front, rear, bottom and cover panels; and d) at least one of said first, second and third membrane flaps being disposed to extend along both said predetermined edge of one of said front, rear, bottom and cover panels and said upper edge of one of said left and right end flaps.

15. A blank as in claim 14, wherein:

a) said left and right end flaps are hingedly connected to corresponding left and right edges of said front panel forming hinge lines therebetween; and b) said first and second membrane flaps each include a tab disposed adjacent corresponding hinge lines formed between said left and right end flaps and said front panel.

16. A blank as in claim 15, wherein:

a) said third membrane flap is hingedly connected to an upper edge of said front panel; and b) each of said tabs include a first edge extending along at least a portion of said upper edge of said front panel, said first edges of said tabs are detached from corresponding portions of said front panel, said tabs each include edges extending substantially perpendicular to said first edges and detached from corresponding adjacent ends of said third membrane flap.

17. A blank as in claim 16, wherein:

a) a substantially v-shaped notch is formed intermediate said first and third membrane flaps and said second and third membrane flaps.

18. A carton for packaging ice cream or the like, comprising:

a) a receptacle having front, rear, bottom, left end and right end walls, said receptacle having an opening formed in an upper surface thereof;

b) a lid for sealing said opening of said receptacle;

c) a lip seal having at least first, second and third sections, said first section extending along at least a portion of said front wall, said second section extending along at least a section of said left end wall, said third portion extending along at least a portion of said right end wall; and d) a tab extending between at least one of said first and second sections and said first and third sections.

19. A carton as in claim 18, wherein:

a) said left end wall includes left front, rear, cover and bottom panel end flaps;

b) said right end wall includes right front, rear, cover and bottom panel end flaps;

c) said front and rear walls each include upper, lower, left and right edges, said bottom wall includes front, rear, left and right edges, said left and right end flaps include upper and lower edges; and d) said second section of said lip seal is hingedly connected to said upper edge of said left front wall end flap, said third section is hingedly connected to said upper edge of said right front wall end flap.

20. A carton as in claim 19, wherein:

a) a tab extends between said first and second sections and said first and third sections;

b) each of said tabs has a thickness substantially equal to a thickness of at least one of said first, second and third sections; and c) said first, second and third sections each have a width and a length substantially greater than a width and a length of said tabs.

21. A carton as in claim 20, wherein:

a) said tabs include first edges which extend along at least a portion of said upper edge of said front wall, said first edges are detached from corresponding portions of said upper edge of said front wall; and b) said tabs further include a second edge extending substantially perpendicular to corresponding first edges and detached from corresponding adjacent ends of said first section of said lip seal.

22. A carton as in claim 21, wherein:

a) a substantially V-shaped notch is formed between said first and second sections and said first and third sections of said lip seal when said carton is in blank form, said tabs are disposed adjacent a bottom portion of a corresponding substantially V-shaped notch.

23. A carton for packaging ice cream or the like, comprising:

a) front, rear and bottom panels;

b) a lid operably associated with said front, rear and bottom panels for forming a hollow tube having first and second open ends, said lid including a cover panel and means for securing said cover panel to one of said front, rear and bottom panels;

c) a first set of end flaps operably associated with said first open end of said hollow tube for sealing said first open end;

d) a second set of end flaps operably associated with said second open end of said hollow tube for sealing said second open end;

e) said first set of end flaps including at least first and second end flaps, said first end flap being offset inwardly of said second end flap;

f) a first membrane flap extending from an upper edge of said second end flap of said first set of end flaps, said first membrane flap extending inwardly toward said second set of end flaps; and g) said first end flap of said first set of end flaps includes upper, lower, front and rear edges, said upper edge being positioned adjacent said cover panel and having a tapered surface extending from said front edge to said rear edge thereby forming an opening between said upper edge of said first end flap of said first set of end flaps and said cover panel for receiving said first membrane flap.

24. A carton as in claim 23, wherein:

a) said rear edge of said first end flap of said first set of end flaps is greater in length than said front edge of said first end flap of said first set of end flaps by an amount substantially equal to a thickness of said first membrane flap.

25. A carton as claim 23, wherein:

a) said first end flap of said first set of end flaps is hingedly connected to said right edge of said bottom panel; and b) said second end flap of said first set of end flaps is hingedly connected to said right edge of said front panel.

26. A carton as in claim 23, wherein:

a) said second set of end flaps include first and second end flaps;

b) a second membrane flap extends from an upper edge of said second end flap of said second set of end flaps, said second membrane flap extends inwardly toward said first set of end flaps;

c) a third membrane flap extends from an upper edge of said front panel;

d) said first end flap of said second set of end flaps includes upper, lower, front and rear edges, said upper edge of said first end flap of said second set of end flaps is positioned adjacent said cover panel and is tapered from said front edge to said rear edge thereby forming an opening between said upper edge of said first end flap of said second set of end flaps and said cover panel for receiving said second membrane flap.

27. A carton as in claim 26, wherein:

a) said first end flap of said second set of end flaps is hingedly connected to said left edge of said bottom panel and said second end flap of said second set of end flaps is hingedly connected to said left edge of said front panel; and b) said first end flaps of said first and second sets of end flaps are the innermost end flaps.

28. A carton as in claim 26, wherein:

a) a tab is positioned intermediate said first and third membrane flaps and said second and third membrane flaps; and b) said tabs have a thickness substantially equal to a thickness of at least one of said first, second and third membrane flaps.

29. A carton as in claim 28, wherein:

a) said first, second and third membrane flaps each have a width and length substantially greater than width and a length of said tabs.

30. A carton as in claim 28, wherein:

a) said tabs each include first and second edges, said first edges extend along at least a portion of said upper edge of said front panel, said first edges are detached from corresponding portions of said upper edge of said front panel, said second edges extend substantially perpendicular to corresponding first edges and are detached from corresponding adjacent ends of said third membrane flap.

31. A carton for packaging ice cream or the like, comprising:

a) a receptacle having front, rear, bottom, left end and right end walls, said receptacle having an opening formed in an upper surface thereof;

b) a lid for sealing said opening of said receptacle;

c) a lip seal having at least first, second and third sections, said first section extending along at least a portion of said front wall, said second section extending along at least a portion of said left end wall, said third section extending along at least a portion of said right end wall; and d) first deformable sealing means for sealing a first portion of said carton, said first deformable sealing means being operably connected to only one of said first, second and third sections.

32. A carton as in claim 31, wherein:

a) said first deformable sealing means is operably connected to only said second section; and b) second deformable sealing means for sealing a second portion of said carton, said second deformable sealing means is operably connected to only said third section.

33. A carton for packaging ice cream and the like, comprising:

a) a receptacle including front, rear, bottom, left end and right end walls; said receptacle having an opening formed in an upper surface thereof;

b) a lid means operably associated with said receptacle for closing said opening in said upper surface;

c) a lip seal extending along at least a portion of an outer periphery of said receptacle, said lip seal includes first, second and third sections, said first section extends along at least a portion of said left end wall, said second section extends along at least a portion of said front wall and said third section extends along at least a portion of said right end wall;

d) first and second tabs, said first tab being disposed intermediate said first and second sections, and hingedly connected to one of said first and second sections, said second tab being disposed intermediate said second and third sections and hingedly connected to one of said second and third sections; and e) said first tab having a width and a length substantially less than a width and a length of at least one of said first and second sections, said second tab having a width and a length substantially less than a width and a length of at least one of said second and third sections.

34. A carton as in claim 33, wherein:

a) said front, rear and bottom panels include left and right edges;

b) said left end wall includes front, rear, bottom and cover wall end flaps;

c) said right end wall includes front, rear, bottom and cover wall end flaps; and d) said walls, said wall end flaps, and said first and second tabs have substantially the same thickness.

35. A carton as in claim 33, wherein:

a) said first and second sections include front, rear, inner and outer edges, said inner edges of said first and third sections include an arcuate portion.

36. A method for forming a carton for packaging ice cream or the like, comprising the steps of:

a) providing front, rear and bottom panels;

b) providing a lid operably associated with said front, rear and bottom panels for forming a hollow tube having first and second open ends, the lid including a cover panel and means for securing the cover panel to one of the front, rear and bottom panels;

c) providing a first set of end flaps operably associated with the first open end of the hollow tube for sealing the first open end;

d) providing a second set of end flaps operably associated with the second open end of the hollow tube for sealing the open end;

e) providing said first set of end flaps with at least first and second end flaps the first end flap being offset inwardly of the second end flap;

f) providing a first membrane flap extending from the second end flap of the first set of end flaps, the first membrane flap extending inwardly toward the second set of end flaps;

g) providing first spacing means for creating an opening between the first end flap of the first set of end flaps and the cover panel for receiving the first membrane flap; and h) positioning the first spacing means on a portion of the carton removed from an upper edge of the first end flap of the first set of end flaps.

37. A method for forming a blank for packaging ice cream and the like, comprising the steps of:

a) providing connected, front, rear, bottom and cover panels, the front and rear panels each having upper, lower, left and right edges the bottom and cover panels each having front, rear, left and right edges;

b) providing left and right end flaps operably associated with corresponding left and right edges of at least one of the front, rear, bottom and cover panels, the left and right end flaps each having upper and lower edges;

c) providing first, second and third membrane flaps, the first membrane flap being operably connected to the upper edge of the left end flap, the second membrane flap being operably connected to the upper edge of the right end flap, the third membrane being operably connected to a predetermined edge of one of the front, rear, bottom and cover panels; and d) positioning at least one of the first, second and third membrane flaps to extend along both the predetermined edge of one of the front, rear, bottom and cover panels and the upper edge of one of the left and right end flaps.

38. A blank for packaging ice cream or the like, comprising:

a) front, rear and bottom panels;

b) a lid operably associated with said front panel, rear and bottom panels for forming a hollow tube having first and second open ends, said lid including a cover panel and means for securing said cover panel to one of said front, rear and bottom panels;

c) a first set of end flaps operably associated with said first open end of said hollow tube for sealing said first open end;

d) a second set of end flaps operably associated with said second open end of said hollow tube for sealing said second open end;

e) said first set of end flaps including at least first and second end flaps, said first end flap being off said inwardly of said second end flap;

f) a first membrane flap extending from said second end flap of said first set of end flaps, said first membrane flap extending inwardly toward said second set of end flaps when said blank is erected; and, g) first spacing means for providing an opening between said first end flap of said first set of end flaps and said cover panel for receiving said first membrane flap when said blank is erected, said first spacing means being formed on a portion of said carton removed from an upper edge of said first end flap of said first set of end flaps.

39. A blank as in claim 38, wherein:

a) said second set of end flaps include at least first and second end flaps, said first end flap is offset inwardly of said second end flap when said blank is erected;

b) a second membrane flap extending from an upper surface of said second end flap of said second set of end flaps, said second membrane flap extending inwardly towards said first set of end flaps when said blank is erected; and, c) second spacing means for providing an opening between said first end flap of said second set of end flaps and said cover panel for receiving said second membrane flap when said blank is erected, said second spacing means is formed on a portion of said blank removed from an upper edge of said first end flap of said second set of end flaps.

40. A blank as in claim 39, wherein:

a) said front and rear panels each include upper, lower, left and right edges;

b) said cover and bottom panels each include front, rear, left and right edges;

c) said first end flap of said first set of end flaps is hingedly connected to said right edge of said bottom panel forming a hinge line therebetween; and, d) said first end flap of said second set of end flaps is hingedly connected to said left edge of said bottom panel forming hinge line therebetween.

41. A blank as in claim 38, wherein:

a) said first end flaps of said first and second set of end flaps are the innermost end flaps when the blank is erected.

42. A blank as in claim 40, wherein:

a) said second end flap of said first set of end flaps is hingedly connected to said right edge of said front panel forming a hinge line therebetween; and, b) said second end flap of said second set of end flaps is hingedly connected to said left edge of said front panel forming a hinge line therebetween.

43. A blank as in claim 42, wherein:

a) said first set of end flaps include cover panel and rear panel end flaps hingedly connected to corresponding right edges of said cover and rear panels;

b) said second set of end flaps include cover panel and rear panel end flaps hingedly connected to corresponding left edges of said cover and rear panels;

c) said rear panel end flaps of said first and second sets of end flaps are the outermost end flaps when the blank is erected; and, d) said first and second sets of end flaps each form pocket means for receiving a portion of corresponding cover panel end flaps for reforming a carton formed by erecting said blank subsequent to initial opening thereof.

44. A blank as in claim 38, wherein:

a) said first end flap of said first set of end flaps includes upper, lower, front and rear edges, said upper edge of said first end flap of said first set of end flaps is tapered from said front edge to said rear edge.

45. A blank as in claim 39, wherein:

a) said first and second membrane flaps include front, rear, inner and outer edges, said inner edges or said first and second membrane flaps including an arcuate portion; and, b) said first and second spacing means each include a tab projecting from a corresponding front edge of said first and second membrane flaps.

46. A blank as in claim 42, wherein:

a) said first and second spacing means each include a tab hingedly connected to corresponding front edges of said first and second membrane flaps forming hinge lines therebetween; and, b) said hinge lines between said tabs and said first and second membrane flaps extend substantially parallel to and are offset from corresponding hinge lines formed between said second end flaps of said first and second sets of end flaps and said front panel.

47. A blank as in claim 45, wherein:

a) said tabs have a thickness substantially equal to a thickness of a corresponding membrane flap.

48. A blank as in claim 45, wherein:

a) said second end flap of said first set of end flaps extends from said right edge of said front panel, said second end flap of said second set of end flaps extends from said left edge of said front panel;

b) a third membrane flap extends from an upper edge of said front panel; and, c) said tabs each include a first edge disposed to extend along at least a portion of said upper edge of said front panel, said first edges of said tabs are detached from corresponding portions of said front panel.

49. A blank as in claim 48, wherein:

a) said tabs each include a second edge disposed to extend substantially perpendicular to correspond first edges, said second edges are detached from corresponding adjacent ends of said third membrane flap.

50. A blank as in claim 49, wherein:

a) a substantially V-shaped notch is formed intermediate said first and third membrane flaps and said second and third membrane flaps; and, b) said tabs are disposed adjacent a bottom portion of a corresponding substantially V-shaped notch.

51. A carton for packaging ice cream or the like, comprising:

a) connected front, rear, bottom and cover panels, said front and rear panels each having upper, lower, left and right edges, said bottom and cover panels each having front, rear, left and right edges;

b) left and right end flaps operably associated with corresponding left and right edges of at least one of said front, rear, bottom and cover panels, said left and right end flaps each having upper and lower edges;

c) first, second and third membrane flaps, said first membrane flap being operably connected to said upper edge of said left end flap, said second membrane flap being operably connected to said upper edge of said right end flap, said third membrane flap being operably connected to a predetermined edge of one of said front, rear, bottom and cover panels; and, d) at least one of said first, second and third membrane flaps being disposed to extend along both said predetermined edge of one of said front, rear, bottom and cover panels and said upper edge of one of said left and right end flaps when said carton is unfolded.

52. A carton as in claim 51, wherein:

a) said left and right end flaps are hingedly connected to corresponding left and right edges of said front panel forming hinge lines therebetween; and, b) said first and second membrane flaps each include a tab disposed adjacent corresponding hinge lines formed between said left and right end flaps and said front panel.

53. A carton as in claim 52, wherein:

a) said third membrane flap is hingedly connected to an upper edge of said front panel; and, b) each of said tabs include a first edge extending along at least a portion of said upper edge of said front panel, said first edges of said tabs are detached from corresponding portions of said front panel, said tabs each include edges extending substantially perpendicular to said first edges and detached from corresponding adjacent ends of said third membrane flap.

54. A carton as in claim 53, wherein:

a) a substantially V-shaped notch is formed intermediate said first and third membrane flaps and said second and third membrane flaps when said carton is in blank form.

55. A blank for packaging ice cream or the like, comprising:

a) front panel, rear panel, bottom panel, at least one left end and at least one right end flap for forming a receptacle having an opening formed in an upper surface thereof when said blank is erected;

b) a lid for sealing the opening of the receptacle;

c) a lip seal having at least first, second and third sections, said first section extending along at least a portion of said front wall, said second section extending along at least a portion of the said left end wall, said third section extending along at least a portion of said right end wall; and, d) a tab extending between at least one of said first and second sections and said first and third sections.

56. A blank as in claim 55, wherein:

a) said at least one left end flap includes left front, rear, cover and bottom panel end flaps;

b) said at least one right end flap includes right front, rear, cover and bottom panel end flaps;

c) said front and rear panels each include upper, lower, left and right edges, said bottom panel includes front, rear, left and right edges, said left and right end flaps include upper and lower edges; and, d) said second section of said lip seal is hingedly connected to said upper edge of said left front panel end flap, said third section is hingedly connected to said upper edge of said right front panel end flap.

57. A blank as in claim 56, wherein:

a) a tab extends between said first and second sections and said front and third section;

b) each of said tabs has a thickness substantially equal to a thickness of at least one of said first, second and third sections; and, c) said first, second and third sections each have a width and a length substantially greater than a width and a length of said tabs.

58. A blank as in claim 57, wherein:

a) said tabs include first edges which extend along at least a portion of said upper edge of said front panel, said first edges are detached from corresponding portions of said upper edge of said front panel; and, b) said tabs further include a second edge extending substantially perpendicular to corresponding first edges and detached from corresponding adjacent ends of said first section of said lip seal.

59. A blank as in claim 58, wherein:

a) a substantially V-shaped notch is formed between said first and second sections and said first and third sections of said lip seal, said tabs are disposed adjacent a bottom portion of a corresponding substantially V-shaped notch.

60. A blank for packaging ice cream or the like, comprising:

a) front, rear and bottom panels;

b) a lid operably associated with said front, rear and bottom panels for forming a hollow tube having first and second open ends, said lid including a cover panel and means for securing said cover panel to one of said front, rear and bottom panels;

c) a first set of end flaps operably associated with said first open end of said hollow tube for sealing said first open end;

d) a second set of end flaps operably associated with said second open end of said hollow tube for sealing said second open end;

e) said first set of end flaps including at least first and second end flaps, said first end flap being offset inwardly of said second end flap;

f) a first membrane flap extending from an upper edge of said second end flap of said first set of end flaps, said first membrane flap extending inwardly toward said second set of end flaps; and, g) said first end flap of said first set of end flaps includes upper, lower, front and rear edges, said upper edge being positioned adjacent said cover panel when said blank is erected and having a tapered surface extending from said front edge to said rear edge thereby forming an opening between said upper edge of said first end flap of said first set of end flaps and said cover panel for receiving said first membrane flap.

61. A blank as in claim 60, wherein:

a) said rear edge of said first end flap of said first set of end flaps is greater in length than said front edge of said first end flap of said first set of end flaps by an amount substantially equal to a thickness of said first membrane flap.

62. A blank as in claim 60, wherein:

a) said first end flap of said first set of end flaps is hingedly connected to said right edge of said bottom panel; and, b) said second end flap of said first set of end flaps is hingedly connected to said right edge of said front panel.

63. A blank as in claim 60, wherein:

a) said second set of end flaps include first and second end flaps;

b) a second membrane flap extends from an upper edge of said second end flap of said second set of end flaps, said second membrane flap extends inwardly toward said first set of end flaps when said blank is erected;

c) a third membrane flap extends from an upper edge of said front panel;

d) said first end flap of said second set of end flaps includes upper, lower, front and rear edges, said upper edge of said first end flap of said second set of end flaps is positioned adjacent said cover panel when said blank is erected and is tapered from said front edge to said rear edge thereby forming an opening between said upper edge of said first end flap of said second set of end flaps and said cover panel for receiving said second membrane flap.

64. A blank as in claim 63, wherein:

a) said first end flap of said second set of end flaps is hingedly connected to said left edge of said bottom panel and said second end flap of said second set of end flaps is hingedly connected to said left edge of said front panel; and, b) said first end flaps of said first and second sets of end flaps are the innermost end flaps.

65. A blank as in claim 63, wherein:

a) a tab is positioned intermediate said first and third membrane flaps and said second and third membrane flaps; and, b) said tabs have a thickness substantially equal to a thickness of at least one of said first, second and third membrane flaps.

66. A blank as in claim 65, wherein:

a) said first, second and third membrane flaps each have a width and a length substantially greater than a width and a length of said tabs.

67. A blank as in claim 65, wherein:

a) said tabs each include first and second edges, said first edge extends along at least a portion of said upper edge of said front panel, said first edges are detached from corresponding portions of said upper edge of said front panel, said second edge extends substantially perpendicular to corresponding first edges and are detached from corresponding adjacent ends of said third membrane flap.

68. A blank for packaging ice cream or the like, comprising:

a front panel, rear panel, bottom panel, at least one left end flap and at least one right end flap for forming a receptacle having an opening formed in an upper surface thereof when said blank is erected;

b) a lid for sealing the opening of the receptacle;

c) a lip seal having at least first, second and third sections, said first section extending along at least a portion of said front panel, said second section extending along at least a portion of said at least one left end flap, said third section extending along at least a portion of said at least one right end flap; and, d) first deformable sealing means for sealing a first portion of a carton erected from said blank, said first deformable sealing means being operably connected to only one of said first, second and third sections.

69. A blank as in claim 68, wherein:

a) said first deformable sealing means is operably connected to only said second section; and, b) second deformable sealing means for sealing a second portion of the carton, said second deformable sealing means is operably connected to only said third section.

70. A blank for packaging ice cream and the like, comprising:

a) front panel, rear panel, bottom panel, at least one left end flap and at least one right end flap for forming a receptacle having an opening formed in an upper surface thereof when the blank is erected;

b) a lid means operably associated with the receptacle for closing the opening in the upper surface;

c) a lip seal extending along at least a portion of an outer periphery of the receptacle when the blank is erected, said lip seal includes first, second and third sections, said first section extends along at least a portion of said at least one left end flap, said second section extends along at least a portion of said front panel and said third section extends along at least a portion of said at least one right end flap;

d) first and second tabs, said first tab being disposed intermediate said first and second sections, and hingedly connected to one of said first and second sections, said second tab being disposed intermediate said second and third sections and hingedly connected to one of said second and third sections; and, e) said first tab having a width and a length substantially less than a width and a length of at least one of said first and second sections, said second tab having a width and a length substantially less than a width and a length of at least one of said second and third sections.

71. A blank as in claim 70, wherein:

a) said front, rear and bottom panels include left and right edges;

b) said at least one left end flap includes front, rear, bottom and cover panel end flaps;

c) said at least one right end flap includes front, rear, bottom and cover panel end flaps; and, d) said panels, said end flaps, and said first and second tabs have substantially the same thickness.

72. A blank as in claim 70, wherein:

a) said first and second sections include front, rear, inner and outer edges, said inner edges of said first and third sections include an arcuate portion.

73. A method of forming a blank for packaging ice cream or the like, comprising the steps of:

a) providing front, rear and bottom panels;

b) providing a lid operably associated with said front, rear and bottom panels for forming a hollow tube having first and second open ends, the lid including a cover panel and means for securing the cover panel to one of the front, rear and bottom panels;

c) providing a first set of end flaps operably associated with the first open end of the hollow tube for sealing the first open end;

d) providing a second set of end flaps operably associated with the second open end of the hollow tube for sealing the open end;

e) providing said first set of end flaps with at least first and second end flaps, the first end flap being offset inwardly of the second end flap when the blank is erected;

f) providing a first membrane flap extending from a second end flap of the first set of end flaps, the first membrane flap extending inwardly toward the second set of end flaps when the blank is erected;

g) providing first spacing means for creating an opening between the first end flap of the first set of end flaps and the cover panel for receiving the first membrane flap when the blank is erected; and, h) positioning the first spacing means on a portion of the blank removed from an upper edge of the first end flap of the first set of end flaps.

74. A method for forming a carton for packaging ice cream and the like, comprising the steps of:

a) providing connected front, rear, bottom and cover panels, the front and rear panels each have upper, lower, left and right edges, the bottom and cover panels each having front, rear, left and right edges;

b) providing left and right end flaps operably associated with corresponding left and right edges of at least one of the front, rear, bottom and cover panels, the left and right end flaps each having upper and lower edges;

c) providing first, second and third membrane flaps, the first membrane flap being operably connected to the upper edge of the left end flap, the second membrane flap being operably connected to the upper edge of the right end flap, the third membrane flap being operably connected to a predetermined edge of one of the front, rear, bottom and cover panels; and, d) positioning at least one of the first, second and third membrane flaps to extend along both the predetermined edge of one of the front, rear, bottom and cover panels and the upper edge of one of the left and right end flaps when said carton is in blank form.

* * * * *